United States Patent [19]

Pahl

[11] Patent Number: 4,881,157

[45] Date of Patent: Nov. 14, 1989

[54] ADJUSTABLE LIGHT FIXTURE

[75] Inventor: Scott T. Pahl, San Ramon, Calif.

[73] Assignee: USI Lighting, Inc., San Leandro, Calif.

[21] Appl. No.: 344,812

[22] Filed: Apr. 27, 1989

[51] Int. Cl.[4] ..... F21V 21/04

[52] U.S. Cl. ..... 362/371; 362/372; 362/432; 362/364; 362/269; 74/531

[58] Field of Search ..... 362/370, 371, 372, 364, 362/432, 269, 365, 368; 248/295.1, 297.2; 74/531

[56] References Cited

U.S. PATENT DOCUMENTS

| | | | |
|---|---|---|---|
| 2,963,255 | 12/1960 | Bobrick | 362/371 |
| 3,518,420 | 6/1970 | Kripp | 362/364 |
| 3,660,651 | 5/1972 | Miles, Jr. | 362/364 |
| 4,173,037 | 10/1979 | Henderson, Jr. et al. | 362/269 |
| 4,232,361 | 11/1980 | Kelsall | 362/269 |
| 4,327,402 | 4/1982 | Aubrey | 362/371 |
| 4,727,460 | 2/1988 | Payne | 362/269 |

*Primary Examiner*—James C. Yeung

*Attorney, Agent, or Firm*—Thomas E. Schatzel

[57] ABSTRACT

A lamp fixture housing is mounted recessed in a ceiling. A slide member is positioned within the housing and slides within two vertical slots located in the housing wall. A lamp assembly is connected to the slide member. A lever arm is pivotally connected to the housing and passes through a central slot in the slide member. The lever arm holds the slide member and lamp assembly in the desired position.

10 Claims, 1 Drawing Sheet

ADJUSTABLE LIGHT FIXTURE

BACKGROUND OF THE INVENTION

1. Field of the Invention

The present invention relates generally to light fixtures and more particularly to light fixtures which are retractable.

2. Description of the Prior Art

Adjustable light fixtures are often used in the retail market where the lighting needs to be changed frequently. Displays of merchandise are often changed and the lighting must be able to adjust to these changes.

Typically, the light fixtures are ceiling mounted within a recessed housing. The lamp fixture may be used in the recessed position to provide general lighting or it may lowered and adjusted to spot light a display of merchandise.

Light fixtures known in the prior art include U.S. Pat. No. 3,660,651, issued May 2, 1972, by Earl Miles, Jr.; U.S. Pat. No. 4,173,037, issued Oct. 30, 1979, by Alfred Hendersen, Jr., et al; U.S. Pat. No. 4,638,970, issued Jan. 27, 1987, by Gerard Phelan; U.S. Pat. No. 4,712,168, issued Dec. 8, 1987, by Fernand Scherrer; and U.S. Pat. No. 4,727,460, issued Feb. 23, 1988, by Gary Payne.

The prior art light fixtures have a number of disadvantages. The large number of parts used in their assembly makes them costly to produce and difficult to adjust. In addition, the light fixtures must be able to hold up to the constant wear of movement. There is a need for an adjustable light fixture which has fewer parts, is able to withstand rugged use, and is less costly to manufacture.

SUMMARY OF THE PRESENT INVENTION

It is therefore an object of the present invention to provide an adjustable light fixture which has fewer parts.

It is another object of the present invention to provide an adjustable light fixture which is able to withstand heavy wear.

Briefly, in a preferred embodiment, the present invention comprises a cylindrical housing which is monted in a ceiling. A slide member is positioned within the housing through a pair of vertical slots within the housing wall. A lever member has a first end pivotally connected to the housing and a second end which passes through a central vertical slot in the slide member. A lamp fixture is attached to the slide member.

An advantage of the present invention is that it provides an adjustable light fixture which has fewer parts.

Another advantage of the present invention is that it provides an adjustable light fixture which is able to withstand heavy wear.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 1:
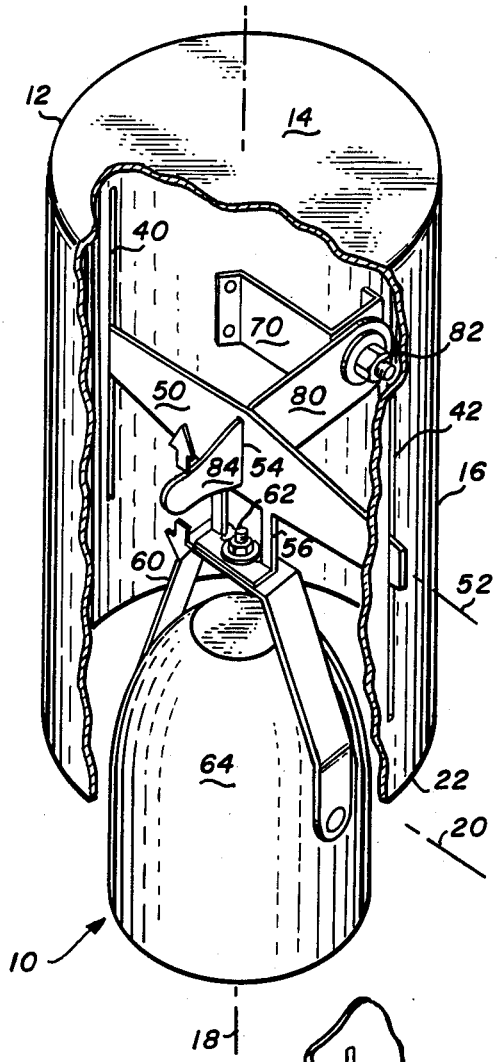
FIG. 1 is a cut-away perspective view of the adjustable light fixture of the present invention.

FIG. 1 shows a perspective view of the adjustable light fixture of the present invention and is designated by the general reference number 10. Fixture 10 comprises a cylindrical housing 12. The housing 12 has a top side 14 and a sidewall 16. Housing 12 has central longitudinal axis 18 and a chordal axis 20. Housing 12 is typically mounted within a ceiling such that a bottom edge 22 of housing 12 is flush with the ceiling.

Housing 12 is shown with a portion cut-away to expose the internal parts. A pair of slots 40 and 42 are cut within the sidewall 16 and are oriented parallel to longitudinal axis 18. The slots 40 and 42 are located on opposite sides of cylinder housing 12 such that slots 40 and 42 are located within the plane which contains both axis 18 and 20. Slots 40 and 42 are the same length and are positioned at the same height such that they both run from a distance below top side 14 to a distance above edge 22.

A flat slide member 50 is shaped to fit within slots 40 and 42. Slide member 50 has a longitudinal axis 52 which is parallel to the chordal axis 20. Slide member 50 has a vertical slot 54 which is aligned parallel to axis 18. Slide member 50 has a bracket extension 56. A U-shaped member 60 is rotationally connected to extension 56 by means of a bolt assembly 62. The bolt assembly 62 allows U-shaped member 60 to rotate about longitudinal axis 18. A reflector and lamp housing assembly 64 is pivotally connected to U-shaped member 60 such that assembly 64 rotates about an axis of rotation which is perpendicular to axis 18.

A bracket 70 is attached to the inside of wall 16. A flat lever arm member 80 is rotationally connected to bracket 70 by a bolt assembly 82. Lever arm member 80 rotates about bracket 70 around a rotational axis which is parallel to axis 52. Lever arm member 80 has an end section 84 which is shaped to fit through slot 54. End section 84 has a shape which allows it to completely fill slot 54 in any position which slide member 50 may take within slots 40 and 42 relative to lever arm member 80.

Figure 2:
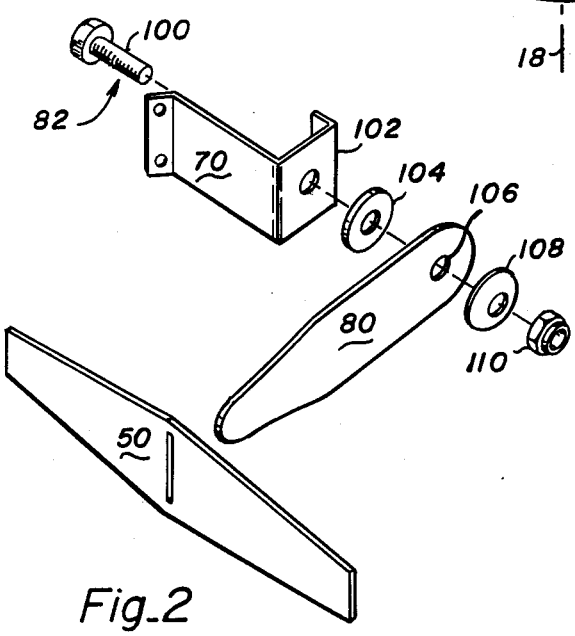
FIG. 2 is an exploded view of a portion of the device of FIG. 1.

FIG. 2 shows an exploded view of slide member 50, bracket 70, lever arm member 80 and bolt assembly 82. Bolt assembly 82 comprises a bolt 100 which is passed through an aperture 102 of bracket 70, a nonmetallic washer 104, an aperture 106 of lever arm member 80, a spring washer 108 and a lock nut 110.

Figure 3:
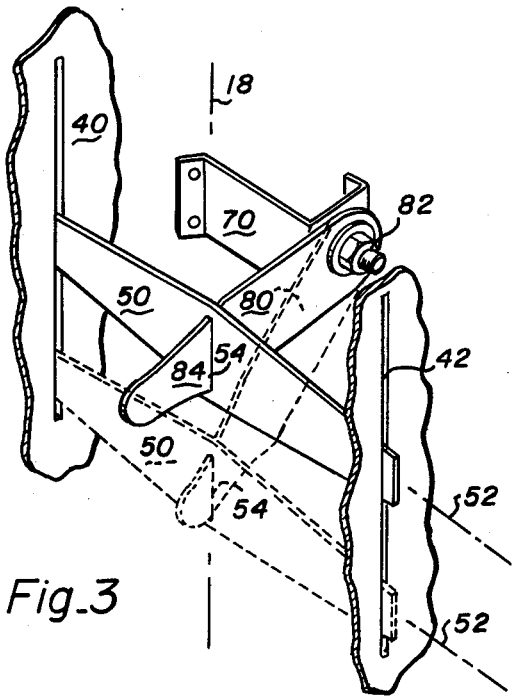
FIG. 3 is a perspective view of a portion of the device of FIG. 1.

FIG. 3 shows the operation of a portion of the fixture 10. When the reflector and lamp housing assembly 64 is pushed or pulled up or down, slide member 50 goes up or down within slots 40 or 42. The slide member fits inside slots 40 and 42 such that it and the attached assembly 64 always moves along vertical axis 18. Slot 54 of slide member 50 receives the flat lever arm 80 such that axis 52 of slide member 50 is always positioned perpendicular to axis 18. The lever arm member 80 holds the slide member 50 and assembly 64 in the adjusted position because of the friction between member 80 and bracket 70 provided by bolt assembly 82.

When the slide member 50 moves up or down, the lever arm 80 moves in and out of slot 54. Lever arm 80 is shaped such that it will always completely fill slot 54 no matter where slide arm 50 is located within slots 40 and 42. This keeps slide arm 50 in its set position relative to lever arm 80. There is no space in slot 54 which would allow slide member 50 to move once lever arm 80 is set.

The advantages of the present invention may now be understood. An adjustable light fixture is provided which has few parts. The light housing may be moved up or down and will always move along a vertical axis. The force required to adjust the fixture may be adjusted by tightening the single bolt assembly 82. The present invention also provides a rugged design which can withstand the constant wear and tear of use.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as all within the true spirit and scope of the invention.

We claim:

1. An adjustable light fixture comprising:

a housing member having a pair of longitudinal slots;

a slide member positioned inside said slots and having a central aperture;

a lever member pivotally connected to said housing and having a first end positioned inside said central aperture; and a lamp assembly connected to said slide member.

2. The device of claim 1 wherein, the lamp assembly comprises a reflector housing pivotally connected to a housing bracket, the housing bracket being rotationally connected to the slide member.

3. The device of claim 1 wherein, said first end of the lever member is shaped to fill the area within the central aperture in any position which the slide member may take within said pair of longitudinal slots.

4. The device of claim 1 wherein, the lever member is pivotally connected to the housing member by means of a bracket connected to said housing member and a bolt assembly connecting the lever arm to said bracket.

5. The device of claim 4 wherein, said bolt assembly comprises a bolt, a nonmetallic washer, a spring washer and a lock nut.

6. An adjustable light fixture comprising:

a cylindrical housing member shaped to receive a lamp fixture, the housing member having a longitudinal axis, the housing member having a pair of slots aligned parallel with said longitudinal axis in a sidewall;

a slide member positioned within said housing member, having a first end located within a first of said pair of slots and a second end located within a second of said pair of slots, the slide member having a slide member axis perpendicular to said longitudinal axis, the slide member having a slide member slot aligned parallel to said longitudinal axis;

a lever member having a first end connected to said housing member by a pivot means, the pivot means having an axis of rotation parallel to said slide member axis, the lever member having a second end positioned within said slide member slot;

a lamp assembly connected to said slide member.

7. The device of claim 6 wherein, the lamp assembly comprises a lamp housing connected to a housing bracket by a second p:vot means, the second pivot means having an axis of rotation perpendicular to said longitudinal axis, the housing bracket connected to the slide arm by rotational means, said rotational means having an axis of rotation parallel to said longitudinal axis.

8. The device of claim 6 wherein, the first end of the lever member is shaped to fill the area of the slide member slot in any position which the slide member may take within said pair of slots.

9. The device of claim 6 wherein, the lever member is pivotally connected to the housing member by means of a bracket connected to said housing member and a bolt assembly connecting the lever arm to said bracket.

10. The device of claim 9 wherein, said bolt assembly comprises a bolt, a nonmetallic washer, a spring washer and a lock nut.

* * * * *